US006655267B2

(12) United States Patent
Mukai et al.

(10) Patent No.: US 6,655,267 B2
(45) Date of Patent: Dec. 2, 2003

(54) SLIDE INCLINATION CORRECTING METHOD AND SLIDE INCLINATION CORRECTING APPARATUS IN PRESS MACHINERY

(75) Inventors: Yoshiro Mukai, Komatsu (JP); Hiroaki Honma, Ishikawa (JP); Katsuhiro Takano, Komatsu (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 10/235,748

(22) Filed: Sep. 6, 2002

(65) Prior Publication Data

US 2003/0010077 A1 Jan. 16, 2003

Related U.S. Application Data

(62) Division of application No. 09/653,192, filed on Aug. 31, 2000.

(30) Foreign Application Priority Data

Sep. 3, 1999 (JP) ..... P11-249509
Oct. 22, 1999 (JP) ..... P11-300466
Oct. 25, 1999 (JP) ..... P11-302080

(51) Int. Cl.[7] ..... B30B 15/24; B30B 5/00
(52) U.S. Cl. ..... 100/258 R; 100/46
(58) Field of Search ..... 100/35, 46, 236, 100/256, 257, 258 R, 258 A, 280; 72/453.02, 453.14, 432, 15.1, 21.4, 21.5, 389.5, 17.2

(56) References Cited

U.S. PATENT DOCUMENTS 2,809,543 A * 10/1957 Zeitlin ..... 100/258 R
3,469,435 A * 9/1969 Trautman ..... 72/20.1
3,768,400 A * 10/1973 Gygli et al. ..... 100/258 R

FOREIGN PATENT DOCUMENTS

JP 62-34998 3/1987
JP 09297317 A * 11/1997 ..... G02F/1/1345

* cited by examiner

*Primary Examiner*—Allen Ostrager
*Assistant Examiner*—Jimmy Nguyen
(74) *Attorney, Agent, or Firm*—Armstrong, Westerman & Hattori, LLP.

(57) ABSTRACT

Disclosed are a slide inclination correcting method and a slide inclination correcting apparatus in press machinery having a slide drive mechanism disposed in a top area of a press machine for driving a slide via a plurality of points to vertically move it up and down, thereby forming a work piece. According to the invention, the method and apparatus include the steps of, and means for, finding by measurement or computation for each of dies or die sets an eccentric load that is to develop in the slide in the process of forming a work piece to prepare a die based slide inclination correcting data for each of the dies or die sets; and on the basis of the die based slide inclination correcting data prepared, pre-imparting to the slide a compensatory amount of inclination which corresponds to a predicted amount of inclination caused the slide due to the eccentric load found.

6 Claims, 9 Drawing Sheets

SLIDE INCLINATION CORRECTING METHOD AND SLIDE INCLINATION CORRECTING APPARATUS IN PRESS MACHINERY

This application is a divisional application of prior application Ser. No. 09/653,192 filed Aug. 31, 2000.

TECHNICAL FIELD

The present invention relates to a slide inclination correcting method and a slide inclination correcting apparatus in press machinery for correcting an inclination of a slide caused by an eccentric load that acts thereon in a press machine while the press machine is in the process of forming, especially a large work piece or a plurality of work pieces.

BACKGROUND ART

Many an existing press machine has a construction in which a slide is movable vertically up and down by a slide drive mechanism disposed in an upper area of the machine. The slide is used to carry on its lower surface a die (upper die) while another die (lower die) is mounted on a bed or bolster in the machine for forming a work piece between these dies.

Also, in a press machine that is relatively large in size and further in what is commonly called a transfer press, one such slide may often be used to form a plurality of work pieces simultaneously. In such cases, it has been experienced that different forming loads applied on the work pieces create an eccentric load acting on the slide.

The slide in a press machine is typically moved vertically up and down as guided on a slide gib laid on a slide body. An eccentric load if produced acting on the slide may cause the slide to be inclined. A deviation in position that will then result between the upper die attached to the slide and the lower die mounted on the bolster makes it impossible to perform forming with precision and also let the dies wear off quickly, thus reducing their life to a large extent.

Also, an inclination of the slide produces a localized rise in bearing pressure between the slide gib and the slide guided thereon, which disadvantageously causes these bearing surfaces to wear off soon or even the bearing members to seize up so that the press machine may become no longer operable.

In an attempt to obviate such disadvantages, there has been proposed an apparatus in the art that is designed to correct a slide inclination in a press machine, e. g., as disclosed in JP U S62-34998. This bulletin discloses a slide inclination correcting apparatus in a press machine, having a makeup in which a overload protector designed to protect the slide from an overload has a fluid chamber therein fed with pressure fluid if a slide inclination is detected.

The correcting apparatus disclosed in that bulletin which in correcting a slide inclination relies on feeding a pressure fluid into the overload protector upon detecting the slide inclination is found to leave itself to be desired, however, presenting several problems. Thus, a time consumed for a pressure to be raised in the overload protector until the inclined slide is properly leveled and a limited accuracy with which it is so raised cause the known apparatus to be of a relatively slow response and limited follow-up capability and hence to be poor in productivity and limited in the abilities to make an accurate correction and thus to form work pieces with precision.

DISCLOSURE OF THE INVENTION

With the view to circumventing the problems met in the prior art, it is an object of the present invention to provide a slide inclination correcting method and a slide inclination correcting apparatus in press machinery which method and apparatus make it possible to achieve forming with due precision without impairing the machine's productivity. The present invention in one aspect thereof resides in finding by measurement or computation for each of dies or die sets an eccentric load that is to develop in the slide in the process of forming a work piece to prepare a die based slide inclination correcting data for each of the dies or die sets; and on the basis of the die based slide inclination correcting data prepared, pre-imparting to the slide a compensatory amount of inclination which corresponds to a predicted amount of inclination caused the slide due to the eccentric load found.

Thus, in order to achieve the object mentioned above, there is provided in accordance with the present invention in a first form of implementation thereof a slide inclination correcting method in press machinery having a slide drive mechanism disposed in a top area of a press machine for driving a slide via a plurality of points to vertically move it up and down, thereby forming a work piece, characterized in that the method comprises the steps of finding by measurement or computation for each of dies or die sets an eccentric load that is to develop in the slide in the process of forming a work piece to prepare a die based slide inclination correcting data for each of the dies or die sets; and on the basis of the die based slide inclination correcting data prepared, pre-imparting to the slide a compensatory amount of inclination which corresponds to a predicted amount of inclination caused the slide due to the eccentric load found.

According to the method described above, an eccentric load that does develop in the course of forming a work piece to act on a slide does not causes the slide to be inclined owing to the fact that a compensatory amount of inclination formed on the basis of a die based slide inclination correcting data for each of dies or die sets is pre-imparted to the slide to counteract the eccentric load. The effects of the method include the ability to form work pieces with due precision without impairing their productivity. Also, causing no deviation in position between an upper and a lower die, the method ensures preventing them from soon wearing off and does practically increases the die life.

The method described may specifically include the steps of detecting an actual amount of inclination of the slide on the basis of which a compensatory amount of inclination may be applied to the slide with the slide leveled thereby so that the slide and the upper surface of a bed or bolster become parallel to each other.

This specific method that seeks to maintain parallelism between the lower surface of the slide and the upper surface of the bed or bolster permits forming with due precision while impairing in no way the productivity. Also, causing no deviation in position between the upper and lower dies, the method ensures preventing them from soon wearing off and does practically increases the die life.

The method described may specifically include the steps of detecting an actual amount of inclination of the slide in the process of forming a work piece, using the actual amount of inclination detected to form a compensatory amount of slide inclination which corresponds thereto; and correcting the die based slide inclination correcting data by feeding back to the die based slide inclination correcting data the compensatory amount of inclination formed.

This specific method that allows the die based slide inclination correcting data to be enhanced in accuracy each time forming is repeated permits the compensatory amount of slide inclination that counteracts the eccentric load to be pre-imparted in each subsequent forming process to the slide in accordance with the die based slide inclination correcting data with a progressively increasing accuracy.

In order to achieve the object mentioned above, the present invention also provides in a second form of implementation thereof a slide inclination correcting apparatus in press machinery having a slide drive mechanism disposed in a top area of a press machine for driving a slide via a plurality of points to vertically move it up and down, thereby forming a work piece, characterized in that the apparatus comprises: a die based slide inclination correcting data acquisition means for acquiring a die based slide inclination correcting data by finding by measurement or computation for each of dies or die sets an eccentric load that is to develop in the slide in the process of forming a work piece; a fluid chamber provided for each of said points; and a slide inclination correcting means for adjusting in quantity a fluid in the fluid chamber on the basis of the die based slide inclination correcting data acquired by the die based slide inclination correcting data acquisition means and thereby pre-imparting to the slide a compensatory amount of inclination that corresponds to a predicted amount of inclination caused the slide due to the eccentric load found.

According to the apparatus described above, an eccentric load that does develop in the course of forming a work piece to act on a slide does not causes the slide to be inclined owing to the fact that a compensatory amount of inclination formed on the basis of a die based slide inclination correcting data for each of dies or die sets is pre-imparted to the slide to counteract the eccentric load. The effects of the method include the ability to form work pieces with due precision without impairing their productivity. Also, causing no deviation in position between an upper and a lower die, the method ensures preventing them from soon wearing off and does practically increases the die life.

Specifically in the apparatus described, a said slide inclination correcting means may comprise a cylinder having a fluid chamber lying in communication with said fluid chamber, and the said compensatory amount of inclination is pre-imparted to the slide by opening and closing a valve means disposed between the first mentioned fluid chamber and the fluid chamber of the cylinder so as to set the fluid in the first mentioned fluid chamber free or let it escape into the fluid chamber in the cylinder.

The construction described above permits making a fine adjustment easily for the slide inclination and, also much being quicker in response and much better in follow-up capability than the prior art of supplying pressure fluid into a fluid chamber, allows the slide leveling to be accomplished promptly and with precision.

The apparatus so constructed as described above may further include a slide inclination detecting means for detecting an actual amount of inclination of the slide in the process of forming a work piece; and a means for applying to a said slide inclination correcting means a feedback control on the basis of a data derived from such detection by the said detecting means.

This specific construction that allows the die based slide inclination correcting data to be enhanced in accuracy each time forming is repeated permits the compensatory amount of slide inclination that counteracts the eccentric load to be pre-imparted in each subsequent forming operation to the slide in accordance with the die based slide inclination correcting data with a progressively increasing accuracy.

The apparatus so constructed as described above may further include a means for correcting the said die based slide inclination correcting data with the slide inclination data derived from detection by the slide inclination detecting means.

This specific construction which permits a die based slide inclination correcting data to be renewed on each occasion with an actual data for slide inclination allows increasing reliability of the die based slide inclination correcting data.

In order to achieve the object mentioned before, the present invention also provides in a third form of implementation thereof a method in which in pre-imparting a compensatory amount of inclination to the slide to compensate for the actual amount of its inclination due to the eccentric load as called for in the first form of implementation, adopts the step of supplying fluid into and discharging fluid from, a fluid chamber provided for each of the said points for the slide on the basis of the said die based slide inclination correcting data.

According to this method described above, an eccentric load that does develop in the course of forming a work piece to act on a slide does not causes the slide to be inclined owing to the fact that a compensatory amount of inclination formed on the basis of a die based slide inclination correcting data for each of dies or die sets is pre-imparted to the slide to counteract the eccentric load. The effects of the method include the ability to form work pieces with due precision without impairing their productivity. Also, causing no deviation in position between an upper and a lower die, the method ensures preventing them from soon wearing off and does practically increases the die life.

The method described above may further comprise the steps of: detecting by a slide inclination detecting means an actual amount of inclination of the slide in the process of forming a work piece; and applying to fluid pressure in the fluid chamber a feedback control on the basis of the actual amount of inclination detected, such that a lower surface of the slide and an upper surface of a bed or bolster becomes parallel to each other.

This specific method that seeks to maintain parallelism between the slide and the upper surface of the bed or bolster permits forming with due precision while impairing the productivity. Also, causing no deviation in position between the upper and lower dies, the method ensures preventing them from soon wearing off and does practically increases the die life.

The method described above may further comprise the steps of: detecting by a slide inclination detecting means an actual amount of inclination of the slide in the process of forming a work piece; and correcting the die based slide inclination correcting data by feeding back to the die based slide inclination correcting data a compensatory amount of slide inclination derived from the actual amount of inclination detected.

This specific construction which permits the die based slide inclination correcting data to be enhanced in accuracy each time forming is repeated allows the compensatory amount of slide inclination that counteracts the eccentric load to be pre-imparted in each subsequent forming operation to the slide in accordance with the die based slide inclination correcting data with a progressively increasing accuracy.

In order to achieve the object mentioned before, the present invention also provides in a fourth form of implementation thereof an apparatus construction wherein in the construction of the second form of implementation, the compensatory amount of inclination corresponding to the actual amount of inclination due to the eccentric load is pre-imparted to the slide by a said slide inclination correcting means when it acts to supply fluid into, and discharge fluid from, said each fluid chamber on the basis of a die based slide inclination correcting data as acquired by the said die based slide inclination correcting data acquisition means.

According to the construction described above, an eccentric load that does develop in the course of forming a work piece to act on a slide does not causes the slide to be inclined owing to the fact that a compensatory amount of inclination formed on the basis of a die based slide inclination correcting data for each of dies or die sets is pre-imparted to the slide to counteract the eccentric load. The effects of the method include the ability to form work pieces with due precision without impairing their productivity. Also, causing no deviation in position between an upper and a lower die, the method ensures preventing them from quickly wearing off and does practically increases the die life.

The apparatus described above may comprise a slide inclination detecting means for detecting an actual amount of inclination of the slide in the process of forming a work piece; and a means for applying to fluid pressure in the fluid chamber a feedback control on the basis of the actual amount of inclination detected, such that a lower surface of the slide and an upper surface of a bed or bolster become parallel to each other.

This specific construction that seeks to maintain parallelism between the lower surface of the slide and the upper surface of the bed or bolster permits forming with due precision while impairing the productivity. Also, causing no deviation in position between the upper and lower dies, the method ensures preventing them from quickly wearing off and does practically increases the die life.

In the construction described above, the fluid chamber provided for each of the points preferably constitutes a fluid chamber for an overload protector.

The construction described above which permits utilizing a fluid chamber in the existing overload-protector for each of the points in performing the correction of a slide inclination allows the apparatus of the invention to be manufactured economically, and, impairing in no way the existing overload protector, ensures that the slide drive mechanism is protected from a overload.

The apparatus described above may comprise a or the slide inclination detecting means for detecting the actual amount of inclination of the slide in the process of forming a work piece; and a means for correcting the die based slide inclination correcting data by feeding back to the die based slide inclination correcting data a compensatory amount of slide inclination derived from the actual amount of inclination detected.

This specific construction which permits the accuracy of the die based slide inclination correcting data to be enhanced each time forming is repeated allows the compensatory amount of slide inclination that counteracts the eccentric load to be pre-imparted in each subsequent forming operation to the slide in accordance with the die based slide inclination correcting data with a progressively increasing accuracy.

In order to achieve the object mentioned before, the present invention also provides in a fifth form of implementation thereof a slide inclination correcting apparatus in press machinery having a slide drive mechanism disposed in a top area of a press body for driving a slide via a plurality of points to vertically move it up and down, thereby forming a work piece, characterized in that the apparatus comprises: a die based slide inclination correcting data acquisition means for acquiring a die based slide inclination correcting data by finding by measurement or computation for each of dies or die sets an eccentric load that is to develop in the slide in the process of forming a work piece; a slide adjustment mechanism provided for each of said points; and a slide inclination correction means for pre-imparting to the slide a compensatory amount of inclination corresponding to a predicted amount of inclination caused the slide due to the eccentric load found, by driving said each slide adjustment mechanism on the basis of the die based slide inclination correcting data acquired by the said die based slide inclination correcting data acquisition means.

According to the construction described above, an eccentric load that does develop in the course of forming a work piece to act on a slide does not causes the slide to be inclined owing to the fact that a compensatory amount of inclination formed on the basis of a die based slide inclination correcting data for each of dies or die sets is pre-imparted to the slide to counteract the eccentric load. The effects of the method include the ability to form work pieces with due precision without impairing their productivity. Also, causing no deviation in position between an upper and a lower die, the method ensures preventing them from quickly wearing off and does practically increases the die life.

Also, designed to make the compensatory amount adjustable mechanically through a slide adjustment mechanism, this construction renders the compensatory amount less affected by heat, and thus allows the slide to be kept leveled with precision. In addition, being superior in reproducibility as well to hydraulics, it serves to yield products formed with an increased precision.

In the apparatus described above, an adjustment motor may be provided for the said slide adjustment mechanism provided for each of said each point.

This construction which permits the slide to be leveled by driving the slide adjustment mechanism for each of the points allows the slide in leveling to be adjusted horizontally in both longitudinal and transverse directions.

The apparatus described above may comprises sets of the said slide adjustment mechanisms with each set comprising a single or a plurality of slide adjustment mechanisms provided, respectively, with an adjustment motor.

This construction that permits simply providing an adjustment motor serves to reduce the number and the cost of parts and components. Reducing the number of adjustment motors also simplifies the entire control system.

The apparatus described above may further comprise a means for bringing an operation of a press machine when running to a halt if a relative difference between compensatory amounts of inclination of different slide adjustment mechanisms exceeds a pre-established value.

This construction allows the operating press machine to come to a halt when the slide is inclined beyond a pre-established value of inclination for a reason such as an error of entry and provides a preventive measure against a problem such as an unusual rise in bearing pressure between the slide and the slide gib which gives rise to an abnormal wear of the bearing surfaces and eventually a seizure there, rendering the slide no longer movable up or down.

The apparatus described above may further include a slide inclination detecting means for detecting an actual amount of inclination of the slide; and a means for applying to the slide adjustment mechanism a feed back control on the basis of the actual amount of inclination detected, such that a lower surface of the slide and an upper surface of a bed or bolster become parallel to each other.

This specific construction that seeks to maintain parallelism between the lower surface of the slide and the upper surface of the bed or bolster permits forming with due precision while impairing the productivity. Also, causing no deviation in position between the upper and lower dies, the method ensures preventing them from quickly wearing off and does practically increases the die life.

The apparatus described above may include a slide inclination detecting means for detecting an actual amount of inclination of the slide; and a means for feeding to the die based slide inclination correcting data a compensatory amount of inclination derived from the actual amount of inclination detected.

This specific construction which permits the accuracy of the die based slide inclination correcting data to be enhanced each time forming is repeated allows the compensatory amount of slide inclination that counteracts the eccentric load to be pre-imparted in each subsequent forming operation to the slide in accordance with the die based slide inclination correcting data with a progressively increasing accuracy.

These and other features, objects and advantages of the invention will be more readily understood or apparent to those skilled in the art from a reading of the following detailed description of preferred forms of embodiment of the present invention as illustrated in the various drawing figures.

BEST MODES FOR CARRYING OUT THE INVENTION

Figure 1:
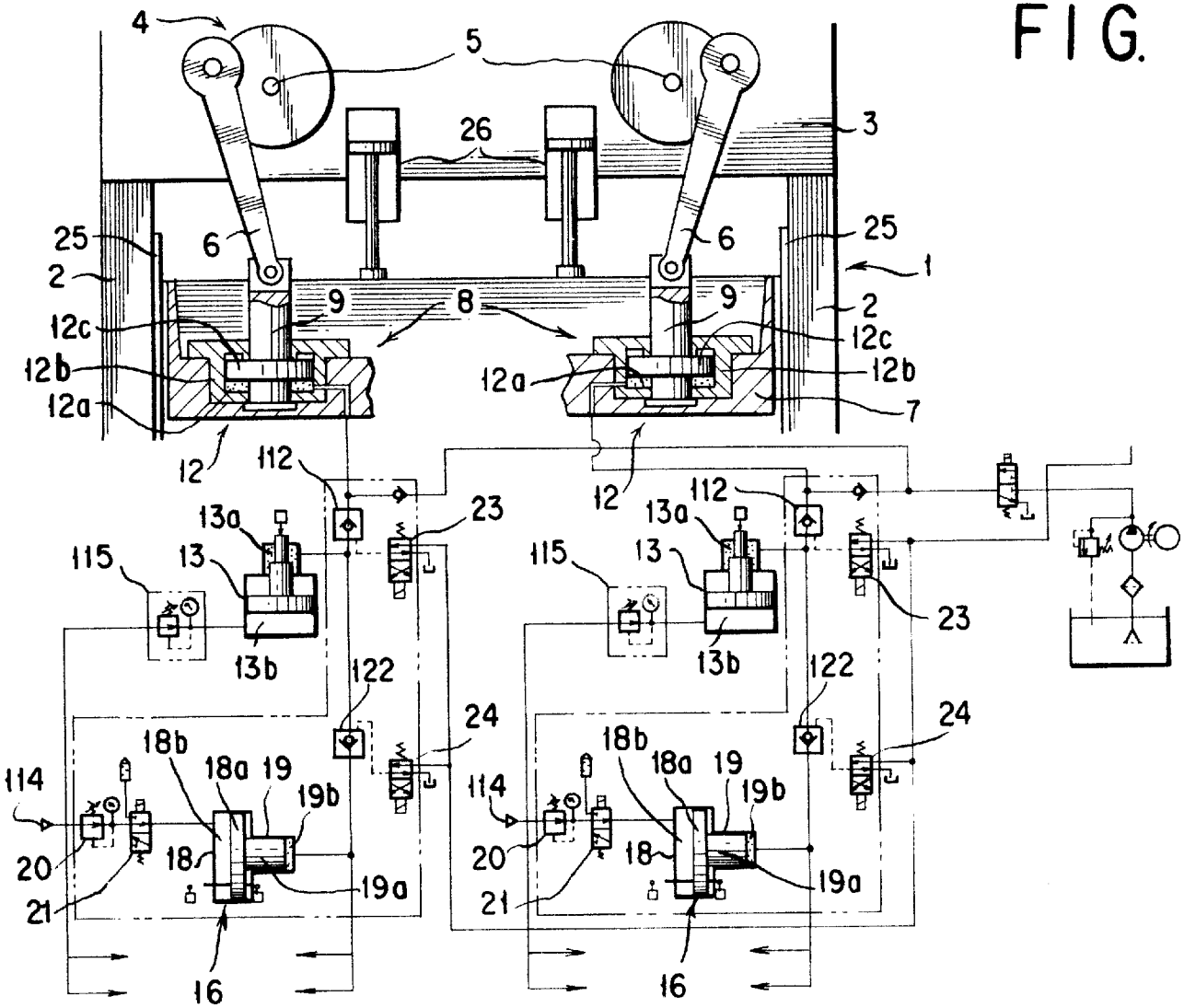
FIG. 1 is a structural view diagrammatically illustrating a slide inclination correcting apparatus in press machinery that represents a first form of embodiment of the present invention.

An explanation in detail follows for each of the various forms of embodiment of the present invention with reference to the drawing figures briefly described above.

Now, mention is made of the first form of embodiment of the invention.

FIG. 1 shows in a structural view a slide inclination correcting apparatus in press machinery that constitutes a first form of embodiment of the invention in which numeral 1 designates a press machine and numeral 2 denotes a plurality of uprights mounted to stand on a machine bed (not shown), and having a crown 3 disposed thereon in which a slide drive mechanism 4 is accommodated.

The slide drive mechanism 4 for driving a slide 7 includes a plurality of, e.g., as shown a pair of, eccentric axles 5 for rotation in opposite directions by a main motor (not shown) and connecting rods 6, e.g., as shown in a pair, each of which has one end side carried by the corresponding eccentric axle 5. Each connecting rod 6 has the other end side pivotally connected to the upper end of a plunger 9 of each of overload protectors 12 which are provided for a plurality of sites of the slide 7, e.g., at two points 8 as shown.

Each of the overload protectors 12 includes a cylinder 12*b* in which a piston 12*c* made integral with the plunger 9 is accommodated as movable vertically up and down. The cylinder 12*b* has its lower chamber constituted by a fluid (oil) chamber 12*a* to which is connected a fluid (oil) chamber 13*a* in an overload protector cylinder 13 via a pilot check valve 112. In addition to the fluid chamber 13*a* which is small in diameter, the overload protector cylinder 13 has an air chamber 13*b* which is large in diameter. Air is supplied into the air chamber 13*b* from an air source 114 via a regulator 115 which regulates air pressure in the air chamber 13*b*.

As shown also, a slide inclination correcting means designated at 16 includes a cylinder 18 that is large in diameter and a cylinder 19 that is small in diameter. The cylinders 18 and 19 have accommodated respectively therein a piston 18*a* that is large in diameter and a piston 19*a* that is small in diameter, the pistons 18*a* and 19*a* being made integral with each other and hence jointly operable. The large diameter cylinder 18 has an air chamber 18*b* into which air is supplied from the air source 114 via a regulator 20 and an electromagnetic valve 21 which regulate and control air pressure in the air chamber 18*b*. The small diameter cylinder 19 has a fluid (oil) chamber 19*b* which is connected via pilot check valve 122 to the fluid chamber 13*a* in the overload protector cylinder 13.

Here, the pilot check valves 112 and 122 are designed to be opened and closed by electromagnetic valves 23 and 24, respectively. The electromagnetic valves 23 and 24 are designed to be switched on and off by a control means (not shown) on the basis of die based slide inclination correcting data pre-stored therein.

Further shown in FIG. 1 are gibs 25 that guide the slide 7 as it is vertically up and down, and balancers 26, each made of an air cylinder, that are included to bias the slide 7 upwards.

An explanation is next given in respect of a method of correcting inclination of the slide 7, i.g., leveling the slide being inclined, by using the slide inclination correcting apparatus described above.

A press machine which is relatively large in size and a transfer press are often required to form a work piece that is large in size or asymmetrical, or to form a plurality of work pieces simultaneously. In such a press machine, the forming load acts on the work piece or work pieces which tends to vary from one site to another, hence development of an eccentric load which acting on the slide 7 causes the slide 7 to incline.

The slide 7 inclined causes an upper die carried by the slide 7 to deviate in position from a lower die mounted on the machine bed or bolster, and this becomes the cause of a forming inaccuracy and the dies soon wearing off The present invention in one aspect thereof is based upon the recognition that such a slide 7 inclination due to an eccentric load that is to develop during a forming operation can on the other hand be predicted from dies for use. Thus, it has been determined that pre-preparing a die based slide inclination correction data for each of dies or die sets individually and pre-imparting a correction or compensation to the slide 7 for its predicted inclination on the basis of the die based slide inclination correcting data allow compensating for an eventual slide inclination with high precision. And, proper choice of die based slide inclination correcting data for a particular die set ensures always achieving a high precision slide inclination compensation while impairing in no way the press machine's ability to accept a variety of die sets.

Accordingly, the first form of embodiment of the present invention involves pre-preparing a die based slide inclination correcting data for each of dies or die sets individually, and storing in a control means the die based slide inclination correcting data together with a die or die set identification data, or alternatively entering such data into the control means when the die or die set is exchanged.

The die based slide inclination correcting data can be prepared as follows:

Where a plurality of work pieces are formed simultaneously, a difference comes out in the eccentric load that is to develop to act on the slide 7 between where they are arranged longitudinally of the press machine 1 and where they are placed transversely of it. A difference also comes out in the eccentric load that is to develop to act on the slide between where the slide drive mechanism 4 and the slide 7 are interconnected via two (2) points and where they are interconnected via four (4) points. Accordingly, a trial run is adopted in which work pieces are tentatively (pilot) formed by a given die set mounted on the press machine. Then, an inclination caused to the slide 7 is measured by a slide inclination detecting means 30, such as made of gap sensors, as shown in FIG. 2.

Figure 2:
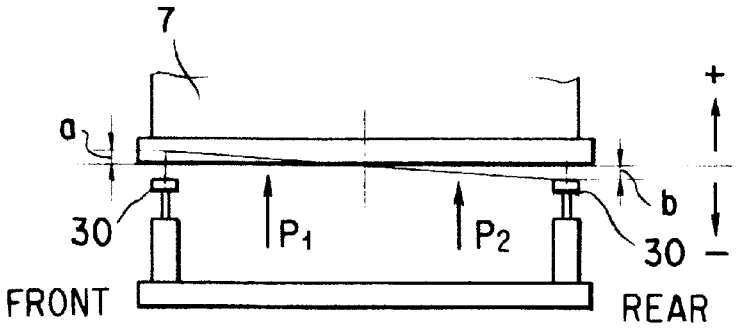
FIG. 2 is an explanatory view diagrammatically illustrating an operation of deriving correction data for use in a slide inclination correcting apparatus in press machinery according to the present invention.

FIG. 2 shows an example of measuring the inclination of the slide 7 produced, e.g., where work pieces are formed by two dies or die sets placed transversely of the press machine. If two forming loads P1 and P2 are produced acting on the slide 7 and P1>P2, , the slide 7 is inclined producing a gap of +a in the front and a gap of −b in the rear and rising towards the front.

Figure 3:
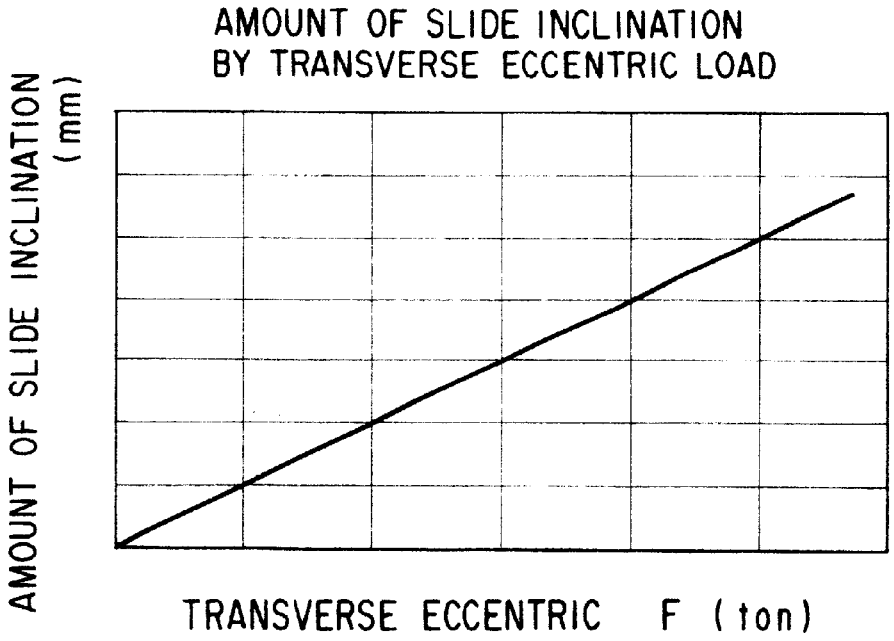
FIG. 3 is a graph showing an amount of inclination of a slide taken with respect to an eccentric load acting on the slide.

FIG. 3 is a graph showing the amount of inclination of the slide 7 with respect to the eccentric load in the transverse (front and rear) direction. The inclination of the slide 7 in the trial (forming) run for each of dies or die sets individually is measured to form a die based slide inclination correcting data which is then stored.

While the preceding paragraphs described a method of deriving a die based slide inclination correcting data by trial-forming work pieces actually, it is also possible to derive the eccentric load by computation when or from designing dies and to prepare a die based slide inclination correcting data for each of dies or die sets individually from the derived eccentric load.

An explanation is next given in respect of a method of correcting inclination of then slide 7 on then basis of the die based slide inclination correcting data in the manner described above.

The operation of forming work pieces using the press machine 1 is initiated by mounting a die set for use onto the press machine 1. When the die set is so mounted, the identification of the dies used is entered into the control means.

This allows the control means to read out from the memory the pertinent die data and die based slide inclination correcting data pre-stored therein and thus to establish the relevant forming conditions and to perform the relevant compensation for the inclination of the slide 7.

The compensation for the slide 7 inclination may be performed when the slide 7 lies standstill at its upper dead point. As an alternative, it may be done after the slide 7 is moved to descend and immediately before the upper dies attached to the slide 7 come into contact with the work pieces placed on the lower dies.

Now, assume that the slide 7 has started descending to form the work pieces using the two die sets. Then, in response to a signal from, e.g., a rotary cam switch means (not shown) used to sense the slide 7 descending and the signal indicating arrival of the slide 7 at its pre-established position, the control means furnishes the electromagnetic valve 24 with a correction signal on the basis of the correction data to compensate for a predicted inclination of the slide 7.

Turned on by this signal, the electromagnetic valve 24 causes the pilot check valve 122 to be furnished with a pilot pressure and the same to be thereby opened. This causes fluid (oil) in the fluid chamber 12*a* of the overload protector 12 on the side in which the lower load P2 acts on the slide 7 to flow into the fluid chamber 19*b* of the slide inclination detecting means 16. As a result, a small inclination is imparted to the slide 7 such that its lower load side is raised by an amount b.

Thereafter, as forming starts with the upper dies touching the work pieces, the slide 7 that is pre-compensated for the inclination in accordance with the predicted eccentric load will be held leveled to form the work pieces while maintaining its parallelism with the upper surface of the bolster. Even with the slide 7, however, that has been compensated for inclination on the basis of the particular die based slide inclination correcting data prepared for the particular die sets used, it may still be possible for some lack of consistency or evenness such as of the thickness of work pieces yet to cause the slide 7 an inclination unexpected.

Thus, in accordance with another aspect of the invention, such an unexpected inclination of the slide 7 in the forming operation is kept detected by the slide inclination detecting means 30 and is fed back to the control means where it is used to renew the die based slide inclination correcting data. Simultaneously, it is used to serve to effect a feedback control of the switching operation for the electromagnetic valves 24 so as to rectify the slide from inclination.

Thereafter, when forming the work pieces ends with the slide 7 reaching its lower dead point, the pilot check valves 112 are opened. This causes fluid in the fluid chamber 19*b* of the slide inclination detecting means 16 to flow into the fluid chamber 12*a* of the overload protector 12, then permitting the slide 7 to restore its original horizontal position.

Thus, even for a forming operation in which in addition to the predicted eccentric load an unexpected eccentric load develops, it becomes possible to perform the forming operation on the basis of the die based slide inclination correcting data prepared for each die set individually, while keeping the slide 7 in-process rectified from possible inclination. This is an enhanced protection for the slide 7 against inclination which makes it possible to achieve precision forming of work pieces without impairing their productivity.

Also, in case an excess load develops during the forming process, the arrangement shown and described including the overload protector 12 allows the slide drive mechanism 4 to be protected against the excess load as heretofore by operating the overload protector cylinder 13 to let the fluid in the fluid chamber 12*a* escape into the overload protector cylinder 13.

Figure 4A:
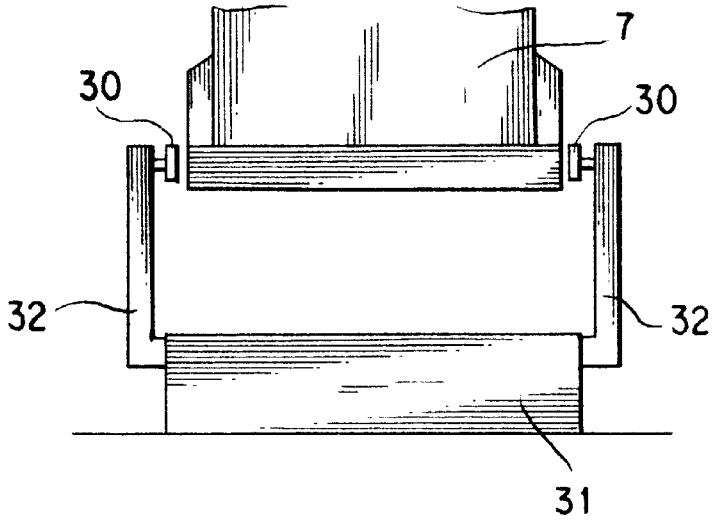
FIGS. 4A and 4B are diagrammatic explanatory views showing an inclination detecting means for use in a slide inclination correcting apparatus in press machinery according to the present invention.
Figure 4B:
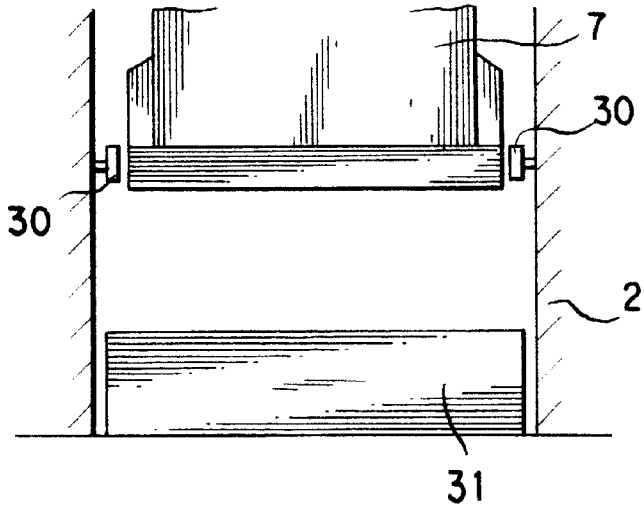

In detecting an inclination of the slide 7, it should be noted that a variety of alternatives are possible. For example, slide inclination detecting means 30 and 30 may be provided, as shown in FIG. 4A, at upper ends of posts 32 and 32 mounted to stand from the bolster 31. Slide inclination detecting means 30 and 30 may also be provided, as shown in FIG. 4B, in walls of uprights 2 and 2. The slide inclination detecting means 30 and 30 are suitably made each of a gap sensor.

It should further be noted that adopting a slide inclination detecting means in accordance with the present invention allows the degrees of freedom of flow of work pieces and die design to be improved to a large extent.

Figure 5A:
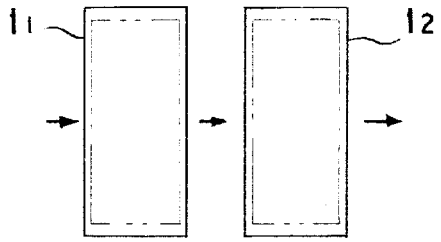
FIGS. 5A to 5D are diagrammatic explanatory views showing the directions of flow of work pieces obtained by adopting a slide inclination correcting apparatus in press machinery according to the present invention.
Figure 5B:
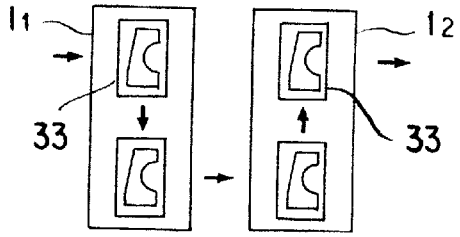
Figure 5C:
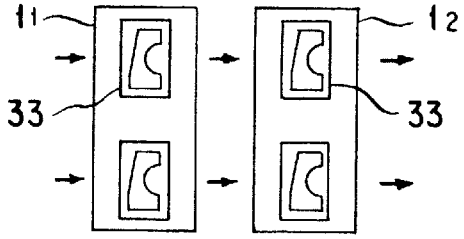
Figure 5D:
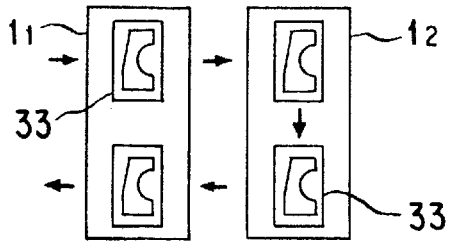

See, for example, FIGS. 5A to 5D which show a tandem press line in which a pair of press machines are installed. In addition to a typical forming process as shown in FIG. 5A in which work pieces are conveyed from the press machine $I_1$ upstream to the press machine $I_2$ downstream to progressively form the work pieces, it becomes possible to mount a plurality of dies or die sets 33 onto each of the press machines $I_1$ and $I_2$ while permitting the work pieces to be conveyed in directions as shown by the arrows in FIGS. 5B to 5D to form the work pieces so in succession. Thus, the ability to admit different forming loads in different process steps ensues which improves the degrees of freedom of the directions in which work pieces are to flow and die design to a large extent.

Mention is next made of a second form of embodiment of the present invention.

Figure 6:
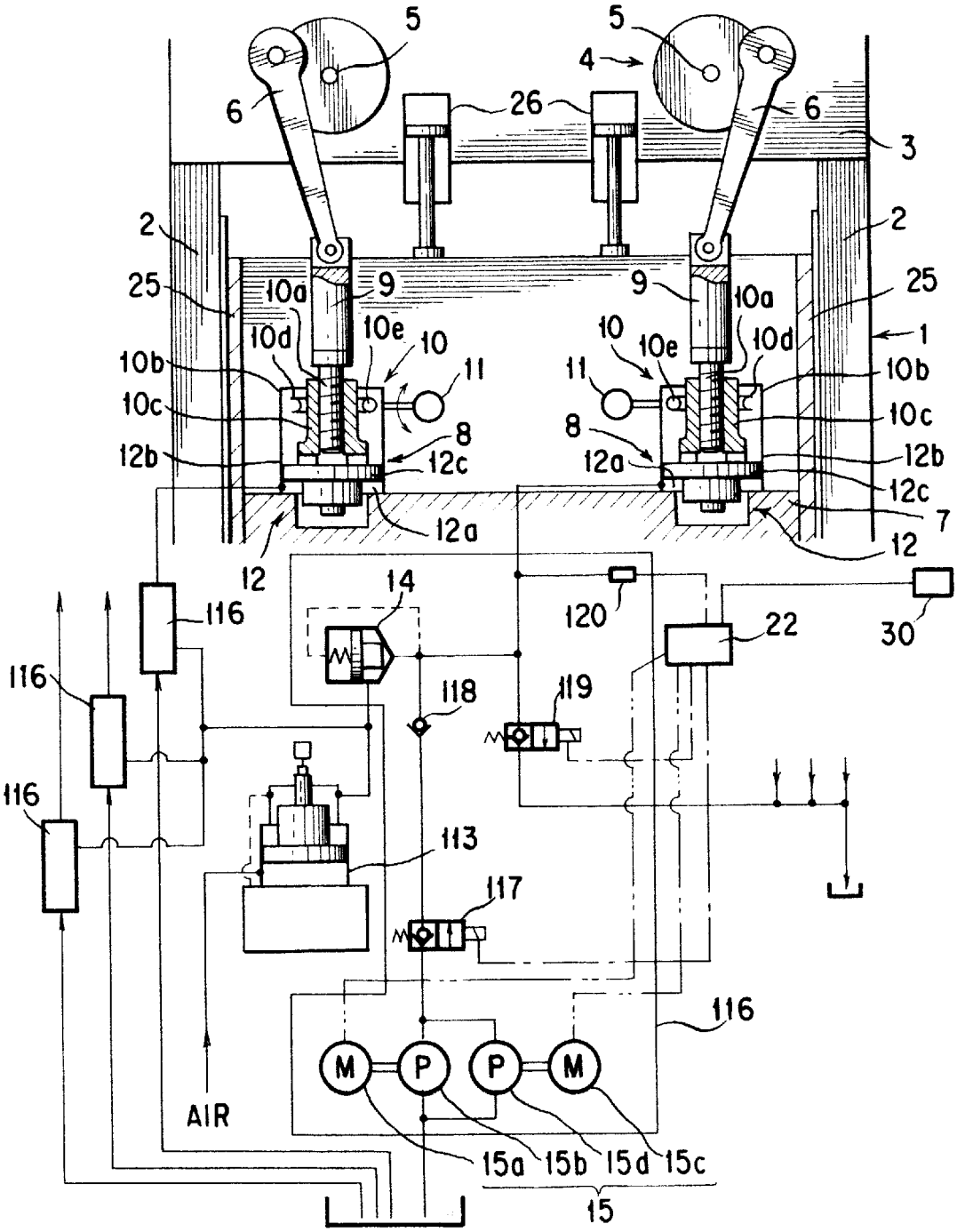
FIG. 6 is a structural view diagrammatically illustrating a slide inclination correcting apparatus in press machinery that represents a second form of embodiment of the present invention.

FIG. 6 shows in a structural view a slide inclination correcting apparatus in press machinery that represents the second form of embodiment of the present invention in which numeral 1 designates a press machine and numeral 2 denotes a plurality of uprights mounted to stand on a machine bed (not shown), and having a crown 3 disposed thereon in which a slide drive mechanism 4 is accommodated.

The slide drive mechanism 4 for driving a slide 7 includes a plurality of, e. g., as shown a pair of, eccentric axles 5 for rotation in opposite directions by a main motor (not shown) and connecting rods 6, e. g., as shown in a pair, each of which has one end side carried by the corresponding eccentric axle 5. Each connecting rod 6 has the other end side pivotally connected via a plunger 9 to the top of the slide at a plurality of sites thereof, e. g., at two points 8 as shown.

The plunger 9 is supported to be slidably movable up and down and has its lower end connected to the upper end of a threaded shaft 10*a* in each of slide adjustment mechanisms 10 provided for each of the points 8.

The slide adjustment mechanisms 10 are provided to adjust the height variably for different dies or die sets. They each have the threaded shaft 10*a* that passes through a gear casing 10*b*, and a nut member 10*c* fitted on the threaded shaft 10*a* in mesh therewith.

The nut member 10*c* has on its outer surface a worm wheel 10*d* fastened thereto which is in mesh with a worm gear 10*e*. Each worm gear 10*e* has a shaft 10*f* which is coupled to each of adjustment motors 11 provided for the slide adjustment mechanisms 10, respectively. Thus, driving each adjustment motor rotates the nut member 10 via the worm gear 10*e* and the worm wheel 10*d*, and rotating the nut member 10*c* in one or the other rotary directions moves the slide 7 up or down to allow the die height to be adjusted as required.

The fluid chambers 12*a* of the overload protectors 12 are provided below the points 8, respectively.

The overload protectors 12 are provided to protect the slide drive mechanisms 4 and so forth from an excess load when the slide 7 is placed under the excess load by letting fluid in a fluid chamber 12*a* escape into an overload protector valve 113. Each of the overload protectors 12 includes a cylinder 12*b* which is disposed below the corresponding point 8 and in which a piston 12*c* is accommodated lower the threaded shaft 10*a* as movable up and down slidably. The space in each cylinder 12*b* below the piston 12*c* constitutes the fluid chamber 12*a*, which is connected to the overload protector valve via a logic valve 14 provided for each of the points 8.

On the other hand, the fluid chamber 12*a* in each of the overload protectors 12 has a slide inclination correcting means 116 connected thereto which is designed to pre-impart to the slide 7 a compensatory amount of inclination determined from a predicted amount of the eccentric load acting on the slide, by supplying fluid into, and discharging fluid from, each of the fluid chambers 12*a*.

Each of the slide inclination correcting means 116 as shown in FIG. 6 includes a fluid pressure source 15 comprising a high pressure hydraulic (oil pressure) pump 15*b* and a low pressure hydraulic pump 15*d* connected in parallel and adapted to be driven by a first and a second motor 15*a* and 15*b*, respectively It also includes an electromagnetic valve 117 that controls supply of fluid from the fluid pressure source 15 into the fluid chamber 12*a* via a check valve 118, and an electromagnetic valve 119 that controls discharging fluid from the fluid chamber 12*a* into a fluid reservoir. It further includes a fluid pressure sensing means 120 that senses fluid pressure in the fluid chamber 12*a*. A signal derived from such sensing by the fluid pressure sensing means 120 and indicating a fluid pressure in the fluid chamber 12*a* is entered into the control means 122, together with a signal representing an inclination of the slide 7 and derived from detection by the inclination detecting means 30 made of, e. g., a gap sensor means. The electromagnetic valves 117 and 119 are designed to be switched on and off on the basis of die based slide inclination correcting data previously stored.

Also shown in FIG. 6 are gibs 25 that guide the slide 7 as it is vertically up and down, and balancers 26, each made of an air cylinder, that are included to bias the slide 7 up wards.

An explanation is next given in respect of a method of correcting inclination of the slide 7, i. g., leveling the slide being inclined, by using the slide inclination correcting apparatus described above.

As mentioned hereinbefore, a press machine which is relatively large in size and a press machine called transfer press are often required to form a work piece that is large in size or asymmetrical, or to form a plurality of work pieces simultaneously. In such a press machine, the forming load acts on the work piece or pieces which tends to vary from one site to another, hence development of an eccentric load which acting on the slide 7 causes the slide 7 to incline.

The slide 7 inclined causes an upper die carried by the lower surface of the slide 7 to deviate in position from a lower die mounted on the machine bed or bolster, and this becomes the cause of a forming inaccuracy and the dies soon wearing off As noted previously, the present invention in one aspect thereof is based upon the recognition that such a slide 7 inclination due to an eccentric load that is to develop during a forming operation can on the other hand be predicted from dies for use. Thus, it has been determined that pre-preparing a die based slide inclination correcting data for each of dies or die sets individually and pre-imparting a correction or compensation to the slide 7 for its predicted inclination on the basis of the die based slide inclination correcting data allow compensating for an eventual slide inclination with high precision. And, proper choice of die based slide inclination correcting data for a particular die set ensures always achieving a high precision slide inclination compensation while impairing in no way the press machine's ability to accept a variety of die sets.

Accordingly, the second form of embodiment of the present invention again involves pre-preparing a die based slide inclination correcting data for each of dies or die sets individually, and storing in a control means 22 the die based slide inclination correcting data together with a die or die set identification data, or alternatively entering such data into the control means 22 when the die or die set is exchanged.

While the die based slide inclination correcting data can be prepared, it should be noted that where a plurality of work pieces are formed simultaneously, a difference comes out in the eccentric load that is to develop to act on the slide 7 between where they are arranged longitudinally of the press machine 1 and where they are placed transversely of it. A difference also comes out in the eccentric load that is to develop to act on the slide between where the slide drive mechanism 4 and the slide 7 are interconnected via two (2) points and where they are interconnected via four (4) points. Accordingly, a trial run is adopted in which work pieces are tentatively (pilot) formed by a given die set mounted on the press machine. Then, an inclination caused to the slide 7 is measured as in the first form of embodiment by slide inclination detecting means 30, each made of, e. g., a gap sensors, placed as shown in FIG. 2.

FIG. 2 shows an example of measuring the inclination of the slide 7 produced, e. g., where work pieces are formed by two dies or die sets placed transversely of the press machine. If two forming loads P1 and P2 are produced acting on the slide 7 and P1>P2, , the slide 7 is inclined producing a gap of +a in the front and a gap of −b in the rear and rising towards the front.

The graph in FIG. 3 shows the amount of inclination of the slide 7 with respect to the eccentric load in the transverse (front and rear) direction. The inclination of the slide 7 in the trial (forming) run for each of dies or die sets individually is measured to form a die based slide inclination correcting data which is then stored.

While the preceding paragraphs described a method of deriving a die based slide inclination correcting data by trial-forming work pieces actually, it is also possible to derive the eccentric load by computation when or from designing dies and to prepare a die based slide inclination correcting data for each of dies or die sets individually from the derived eccentric load.

An explanation is next given in respect of a method of correcting inclination of then slide 7 on then basis of the die based slide inclination correcting data in the manner described above.

The operation of forming work pieces using the press machine is initiated by mounting a die set for use onto the press machine. When the die set is so mounted, the identification of the dies used is entered into the control means 22.

This allows the control means 22 to read out from the memory the pertinent die data and die based slide inclination correcting data pre-stored therein and thus to establish the relevant forming conditions and to perform the relevant compensation for the inclination of the slide 7.

The compensation for the slide 7 inclination may be performed when the slide 7 lies standstill at its upper dead point. As an alternative, it may be done after the slide 7 is moved to descend and immediately before the upper dies attached to the slide 7 come into contact with the work pieces placed on the lower dies. A further alternative is to do it for a time period after the slide 7 starts descending from its upper dead point and until the upper dies attached to the slide comes into contact with the work pieces.

Now, assume that the slide 7 has started descending to form the work pieces using the two die sets. Then, in response to a signal from, e. g., a rotary cam switch means (not shown) used to sense the slide 7 descending and the signal indicating arrival of the slide 7 at its pre-established position, the control means 22 in order to compensate for a predicted inclination of the slide 7 furnishes the electromagnetic valves 117 and 119 with a correction signal on the basis of the die based slide inclination correcting data to control supplying fluid into, and discharging fluid from, the fluid chambers 12*a*, thereby pre-imparting to the slide 7 a compensatory amount of inclination in the manner stated below.

Thus, the electromagnetic valve 119 in communication with the fluid chambers 12*a* in the rear side of the slide where the lower load P2 acts on the slide 7 during forming is turned on to discharge fluid in that fluid chamber 12*a*, thereby raising the rear side of the slide 7 relatively by an amount b.

It should be noted that if the slide 7 inclination due to the eccentric load is minute, the high pressure hydraulic pump 15*b* by the motor 15*a* may be driven and the electromagnetic valve 117 may also be turned on to supply high pressure fluid into the fluid chamber 12*a* located in the front side of the slide 7 where the higher forming load P1 acts on the slide so that the amount of compression of the pressure fluid in that fluid chamber 12*a* of the slide 7 may be reduced and thus to lower the front side of the slide 7 relatively by an minute amount a.

It is also possible to relatively raise the rear side of the slide 7 where the lower forming load P2 acts on the slide by discharging through the electromagnetic valve 119 fluid in the fluid chamber 12*a* located in the rear side of the slide where the lower forming load P2 acts on the slide and simultaneously to relatively lower by a minute amount the front side of the slide 7 where the higher forming load P1 acts on the slide by supplying through the high pressure pump 15*b* fluid into the fluid chamber 12*a* located in the front side of the slide 7 where the higher forming load P1 acts on the slide.

As a result, a compensatory amount of inclination that is commensurate with a predicted eccentric load is pre-imparted to the slide 7 before forming the work pieces is started.

Thereafter, as forming starts with the upper dies touching the work pieces, the slide 7 that is pre-compensated for the inclination in accordance with the predicted eccentric load will be held leveled to form the work pieces while its lower surface maintaining parallelism with the upper surface of the bolster. Even with the slide 7, however, that has been compensated for inclination on the basis of the particular die based slide inclination correcting data prepared for the particular die sets used, it may still be possible for some lack of consistency or evenness such as of the thickness of work pieces yet to cause the slide 7 an inclination unexpected.

Thus, in accordance with another aspect of the invention, such an unexpected inclination of the slide 7 in the forming operation is kept detected by the slide inclination detecting means 30 and is fed back to the control means 22 where it is used to renew the die based slide inclination correcting data. Simultaneously, it is used to serve to effect a feedback control of the switching operations for the electromagnetic valves 117 and 119 and thus of the fluid pressures in the fluid chambers 12*a* so as to rectify the slide 7 from inclination.

Thereafter, when forming the work pieces ends with the slide 7 reaching its lower dead point, the low pressure hydraulic pump 15*d* by the motor 15*c* is driven and also the electromagnetic valve 119 is turned off to cause low pressure fluid to be supplied by the low pressure hydraulic pump 15*d* into the fluid chamber 12*a* located in the rear side of the slide 7, thus permitting the slide 7 to restore its original horizontal position.

If high pressure fluid has been supplied by the high pressure hydraulic pump 15*b* into the fluid chamber 12*a* located in the front side of the slide 7 and the amount of compression of pressure fluid in the fluid chamber 12*a* thereby reduced, it should be noted that the fluid pressure in that fluid chamber 12*a* in the front side of the slide 7 will be drained via the electromagnetic valve 119 into the reservoir, thus permitting the slide 7 to restore its original horizontal position.

Also, if fluid in the fluid chamber 12*a* located in the rear side of the slide 7 has been drained via the electromagnetic valve 119 into the reservoir and high pressure fluid has been supplied into the fluid chamber 12*a* located in the front side of the slide 7 to lower the front side of the slide 7 by a minute amount, it should be noted that low pressure fluid will be supplied by the low pressure hydraulic pump 15*d* into the fluid chamber 12*a* located in the rear side of the slide 7 and pressure fluid in the fluid chamber 12*a* located in the front side of the slide 7 will be drained into the reservoir, thus permitting the slide 7 to restore its original horizontal position.

Thus, even for a forming operation in which in addition to the predicted eccentric load an unexpected eccentric load develops, it becomes possible to perform the forming operation on the basis of the die based slide inclination correcting data prepared for each die set individually, while keeping the slide 7 in-process rectified from possible inclination. This is an enhanced protection for the slide 7 against inclination which makes it possible to achieve precision forming of work pieces without impairing their productivity.

Also, in case an excess load develops during the forming process, the arrangement shown and described including the logic valve 14 allows the slide drive mechanism 4 to be protected against the excess load as heretofore since the logic valve then operates to let the fluid in the fluid chamber 12*a* escape into the overload protector valve 113.

In detecting an inclination of the slide 7, it should be noted that a variety of alternatives are possible in the second form of embodiment as well. For example, slide inclination detecting means 30 and 30 may be provided, as shown in FIG. 4A, at upper ends of posts 32 and 32 mounted to stand from the bolster 31. Slide inclination detecting means 30 and 30 may also be provided, as shown in FIG. 4B, in walls of uprights 2 and 2. The slide inclination detecting means 30 and 30 are suitably made each of a gap sensor.

It should further be noted that adopting a slide inclination detecting means in accordance with the present invention allows the degrees of freedom of flow of work pieces and die design to be improved to a large extent.

See, for example, FIGS. 5A to 5D which show a tandem press line as in the first form of embodiment in which a pair of press machines are installed. In addition to a typical forming process as shown in FIG. 5A in which work pieces are conveyed from the press machine $I_1$ upstream to the press machine $I_2$ downstream to progressively form the work pieces, it becomes possible to mount a plurality of dies or die sets 33 onto each of the press machines $I_1$ and $I_2$ while permitting the work pieces to be conveyed in directions as shown by the arrows in FIGS. 5B to 5D to form the work pieces so in succession. Thus, the ability to admit different forming loads in different process steps ensues which improves the degrees of freedom of the directions in which work pieces are to flow and die design to a large extent.

Next, mention is made of a third form of embodiment of the present invention.

Figure 7:
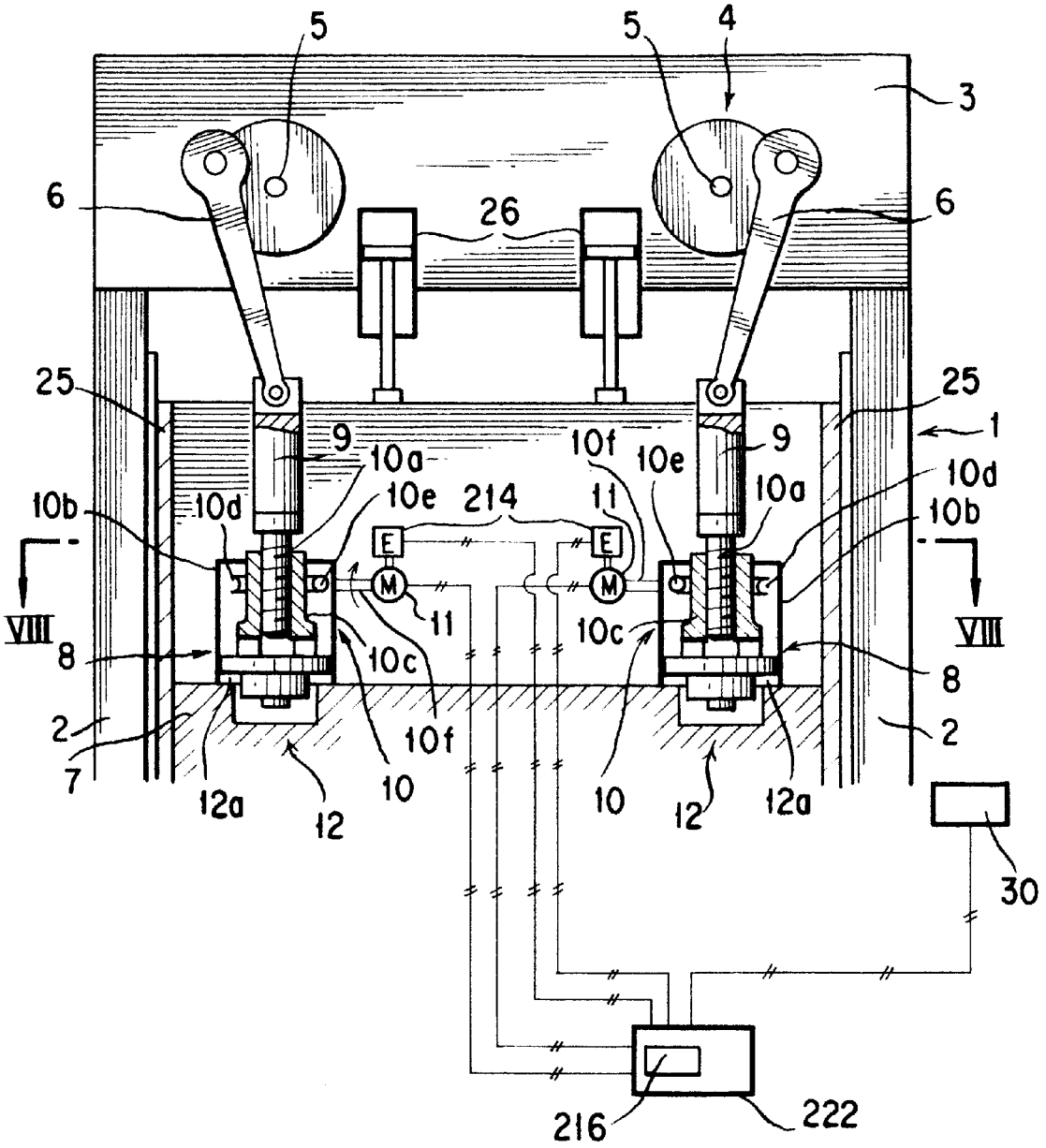
FIG. 7 is a structural view diagrammatically illustrating a slide inclination correcting apparatus in press machinery that represents a third form of embodiment of the present invention.

FIG. 7 shows in a structural view a slide inclination correcting apparatus in press machinery that constitutes the third form of embodiment of the present invention in which numeral 1 designates a press machine and numeral 2 denotes a plurality of uprights mounted to stand on a machine bed (not shown), and having a crown 3 disposed thereon in which a slide drive mechanism 4 is accommodated.

The slide drive mechanism 4 for driving a slide 7 includes a plurality of, e. g., as shown a pair of, eccentric axles 5 for rotation in opposite directions by a main motor (not shown) and connecting rods 6, e. g., as shown in a pair, each of which has one end side carried by the corresponding axle 5. Each connecting rod 6 has the other end side pivotally connected via a plunger 9 to the top of the slide at a plurality of sites thereof, e. g., at two points 8 as shown.

The plunger 9 is supported by the crown 3 to be slidably movable up and down and has its lower end connected to the upper end of a threaded shaft 10*a* in each of slide adjustment mechanisms 10 provided for each of the points 8, respectively.

The slide adjustment mechanisms 10 are provided to adjust the die height variably for different dies or die sets. They each have the threaded shaft 10*a* that passes through a gear casing 10*b*, and a nut member 10*c* fitted on the threaded shaft 10*a* in mesh therewith.

The nut member 10*c* has on its outer surface a worm wheel 10*d* fastened thereto which is in mesh with a worm 10*e*.

Figure 8:
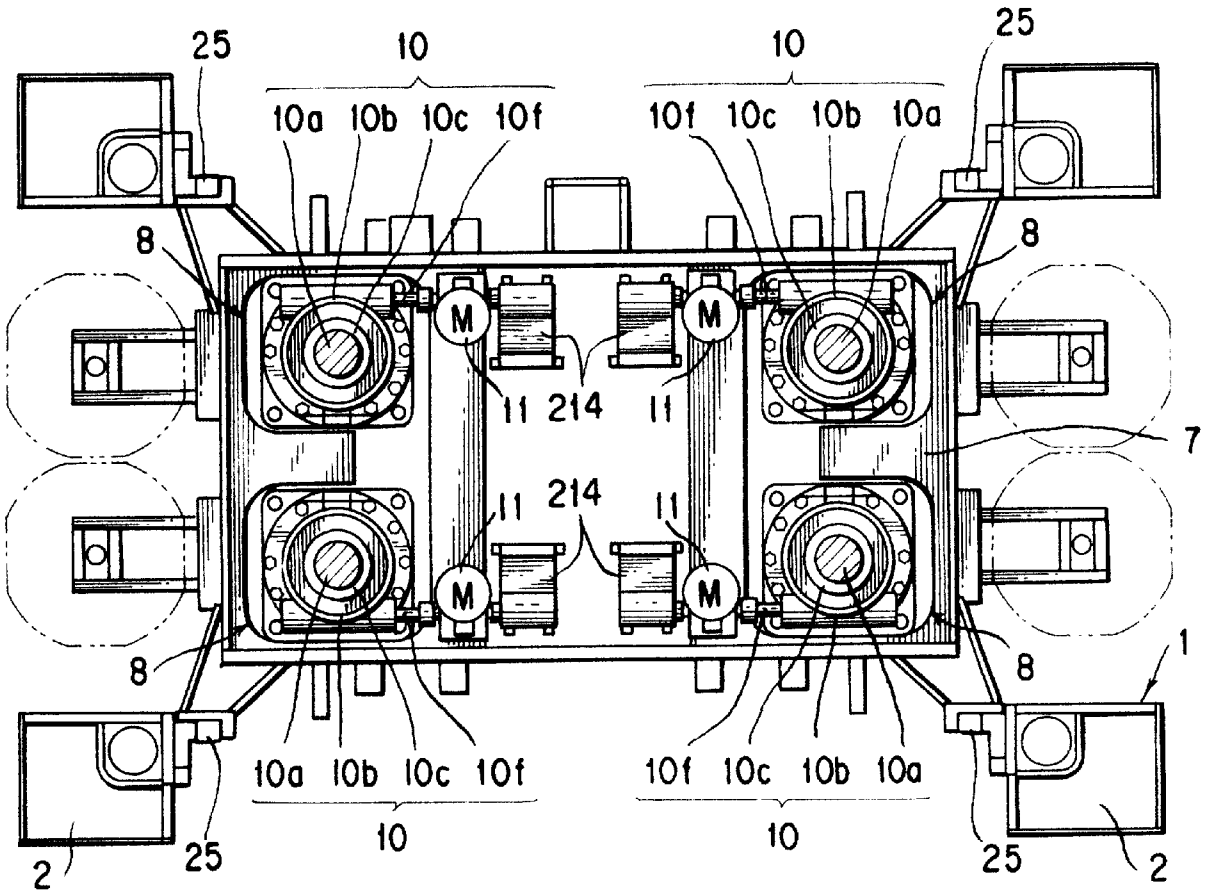
FIG. 8 is a cross sectional view diagrammatically illustrating the apparatus taken along the line VIII—VIII in FIG. 7.

Each worm 10*e* has a shaft 10*f* which as shown in FIG. 8 projects horizontally from the gear casing 10*b* and is coupled to each of adjustment motors 11 provided for the slide adjustment mechanisms 10, respectively.

The adjustment motors 11 are controllably connected to a control means 222 such that driving with its commands the adjustment motors simultaneously moves the slide 7 vertically up/down to allow the die height to be adjusted as required.

The control means 222 is provided with a slide inclination correcting means 216 for pre-imparting a compensatory amount of inclination determined by a predicted eccentric load acting on the slide 7. Thus, controlling the drive of each of the adjustment motors 11 individually pre-imparts to the slide 7 a compensatory amount of inclination determined by a predicted eccentric load. Each adjustment motor 11 also has a slide position sensing means 214 such as an encoder connected thereto for detecting the position of the slide 7 at each of the points 8, and a position indicating signal from the sensing means 214 is input into the control means 222, together with a signal from the slide inclination detecting means 214, each made of, e. g., a gap sensor, for detecting an actual inclination of the slide 7.

In FIG. 7 there are also shown overload protectors 12 each of which is arranged below each of the points 8, respectively, and fluid chambers 12*a*. Each of the fluid chambers 12*a* is connected to an overload protector valve (not shown) arranged so that development of an excess load on the slide during the forming process sets fluid in these fluid chambers 12*a* free into the overload protector valve, thereby preventing the slide drive mechanism 4 from damaging by the excess load.

Further shown in FIG. 7 are gibs 25 that guide the slide 7 as it is vertically up and down, and balancers 26, each made of an air cylinder, that are included to bias the slide 7 upwards.

An explanation is next given in respect of a method of correcting inclination of the slide 7, i. g., leveling the slide being inclined, by using the slide inclination correcting apparatus described above.

As mentioned hereinbefore, a press machine which is relatively large in size and a press machine called transfer press are often required to form a work piece that is large in size or asymmetrical, or to form a plurality of work pieces simultaneously. In such a press machine, the forming load acts on the work piece or pieces which tends to vary from one site to another, hence development of an eccentric load which acting on the slide 7 causes the slide 7 to incline.

The slide 7 inclined causes an upper die carried by the lower surface of the slide 7 to deviate in position from a lower die mounted on the machine bed or bolster, and this becomes the cause of a forming inaccuracy and the dies soon wearing off As noted previously, the present invention in one aspect thereof is based upon the recognition that such a slide 7 inclination due to an eccentric load that is to develop during a forming operation can on the other hand be predicted from dies for use. Thus, it has been determined that pre-preparing a die based slide inclination correcting data for each of dies or die sets individually and pre-imparting a correction or compensation to the slide 7 for its predicted inclination on the basis of the die based slide inclination correcting data allow compensating for an eventual slide inclination with high precision. And, proper choice of die based slide inclination correcting data for a particular die set ensures always achieving a high precision slide inclination compensation while impairing in no way the press machine's ability to accept a variety of die sets.

Accordingly, the third form of embodiment of the present invention again involves pre-preparing a die based slide inclination correcting data for each of dies or die sets individually, and storing in a control means 222 the die based slide inclination correcting data together with a die or die set identification data, or alternatively entering such data into the control means 222 when the die or die set is exchanged.

While the die based slide inclination correcting data can be prepared, it should be noted that where a plurality of work pieces are formed simultaneously, a difference comes out in the eccentric load that is to develop to act on the slide 7 between where they are arranged longitudinally of the press machine 1 and where they are placed transversely of it. A difference also comes out in the eccentric load that is to develop to act on the slide between where the slide drive mechanism 4 and the slide 7 are interconnected via two (2) points and where they are interconnected via three (3) or four (4) points. Accordingly, a trial run is adopted in which work pieces are tentatively (pilot) formed by a given die set mounted on the press machine. Then, an inclination caused to the slide 7 is measured as in the first form of embodiment by slide inclination detecting means 30, e. g., made of gap sensors, disposed on the bolster 31 spaced apart each other in the front and the rear as shown in FIG. 2.

FIG. 2 shows an example of measuring the inclination of the slide 7 produced, e. g., where work pieces are formed by two dies or die sets placed transversely of the press machine. If two forming loads P1 and P2 are produced acting on the slide 7 and P1>P2, the slide 7 is inclined producing a gap of +a in the front and a gap of −b in the rear and rising towards the front.

The graph of FIG. 3 shows the amount of inclination of the slide 7 with respect to the eccentric load in the transverse (front and rear) direction. The inclination of the slide 7 in the trial (forming) run for each of dies or die sets individually is measured to form a die based slide inclination correcting data which is then stored.

While the preceding paragraphs described a method of deriving a die based slide inclination correcting data by trial-forming work pieces actually, it is also possible to derive the eccentric load by computation when or from designing dies and to prepare a die based slide inclination correcting data for each of dies or die sets individually from the derived eccentric load.

An explanation is next given in respect of a method of correcting inclination of then slide 7 on then basis of the die based slide inclination correcting data in the manner described above.

The operation of forming work pieces using the press machine is initiated by mounting a die set for use onto the press machine. When the die set is so mounted, the identification of the dies used is entered into the control means 222.

This allows the control means 222 to read out from the memory the pertinent die data and die based slide inclination correcting data pre-stored therein and thus to establish the relevant forming conditions and to perform the relevant compensation for the inclination of the slide 7.

The compensation for the slide 7 inclination may be performed when the slide 7 lies standstill at its upper dead point. As an alternative, it may be done after the slide 7 is moved to descend and immediately before the upper dies attached to the slide 7 come into contact with the work pieces placed on the lower dies. A further alternative is to do it for a time period after the slide 7 starts descending from its upper dead point and until the upper dies attached to the slide comes into contact with the work pieces.

Now, assume that the slide 7 has started descending to form the work pieces using the two die sets. Then, in response to a signal from, e. g., a rotary cam switch means (not shown) used to sense the slide 7 descending and the signal indicating arrival of the slide 7 at its pre-established position, the control means 222 in order to compensate for a predicted inclination of the slide 7 furnishes the adjustment motor 11 in the slide adjustment mechanisms 10 (provided for the points 8, respectively) with a correction signal on the basis of the die based slide inclination correcting data to cause the adjustment motors 11 to drive the slide 7 via the slide adjustment mechanism 10, thereby pre-imparting thereto a compensatory amount of inclination in the manner stated below.

Thus, the adjustment motor 11 in the slide adjustment mechanism 10 provided for the point 8 in the front side of the slide 7 where the higher forming load P1 acts on the slide 7 is driven to relatively lower that higher forming load, front side of the slide 7 by an amount a upon rotating the nut member 10*c* via the worm 10*e* and the worm wheel 10*d*. Alternatively, the adjustment motor 11 in the slide adjustment mechanism 10 provided for the point 8 in the rear side of the slide 7 where the lower forming load P2 acts on the slide 7 is driven to relatively raise that lower forming load, rear side of the slide 7 by an amount b upon rotating the nut member 10*c* via the worm 10*e* and the worm wheel 10*d*.

As an alternative, it should be noted that the slide adjustment mechanism 10 provided for the point 8 in the front side of the slide 7 where the higher forming load P1 acts on the slide 7 may be operated to lower that higher forming load, front side of the slide 7 while the slide adjustment mechanism 10 provided for the point 8 in the rear side of the slide where the lower forming load P2 acts on the slide 7 is operated to raise that lower forming load, rear side of the slide 7, thereby pre-imparting thereto a compensatory amount of inclination.

As a result, the compensatory amount of inclination that is commensurate with a predicted eccentric load is pre-imparted to the slide 7 before forming the work pieces is started. At the same time, the position of the slide 7 that has been moved up and down for each of the points 8 is detected for each of the points by the slide position sensing means 214 connected to each of the adjustment motors 11, respectively, and is fed back to the control means 222. This facilitates, and increases the accuracy of, a fine adjustment by the slide adjustment mechanisms 10

It should also be noted that the control means 22 has a pre-established value stored therein which represents an admissible limit of inclination of the slide. This arrangement is provided to prevent development of an abnormal rise in bearing pressure between the slide gib and the slide guided thereby, which develops when the slide 7 is inclined beyond such as limit and causes an abnormal wear of the bearing surfaces and a seizure of the bearing members, eventually rendering the slide 7 incapable of moving up and down. To this end, the control means 222 compares with the pre-established as a threshold a position signal from the position sensing means 214 connected to the adjustment motors 11 for the slide adjustment mechanisms 10. If the relative difference of their outputs in magnitude exceeds the pre-established value, an emergency signal is output from the control means, causing the running press machine 1 to come to a halt.

It may be noted that causes that may bring about the amount of correction by the slide adjustment mechanisms 10 exceeding the pre-established value include, besides entry by error of a value of correction, a failure of the position sensing means 214, and a malfunction of the slide adjustment means 10. If the failure of the position sensing means 214 is the cause, bringing the press machine 1 to a halt when the pre-established value is exceeded by the relative difference between signals from the slide inclination detecting means 30 can doubly ensure its safety.

Thereafter, as forming starts with the upper dies touching the work pieces, the slide 7 that is pre-compensated for the inclination in accordance with the predicted eccentric load will be held leveled to form the work pieces while its lower surface maintaining parallelism with the upper surface of the bolster. Even with the slide 7, however, that has been compensated for inclination on the basis of the particular die based slide inclination correcting data prepared for the particular die sets used, it may still be possible for some lack of consistency or evenness such as of the thickness of work pieces yet to cause the slide 7 an inclination unexpected.

Thus, in accordance with another aspect of the invention, such an unexpected inclination of the slide 7 in the forming process is kept detected by the slide inclination detecting means 30 and is fed back to the control means 222 where it is used to renew the die based slide inclination correcting data. Simultaneously, it is used to serve to effect a feedback control of the rotations of the adjustment motors 11 in both rotary directions and thus of the operations of the slide adjustment mechanisms 10 so as to rectify the slide 7 from inclination.

Thereafter, when forming the work pieces ends with the slide 7 reaching its lower dead point, the slide 7 starts rising and the adjustment motors 11 are so driven that the higher forming load P1, slide front side if it was lowered by the amount a, or the lower forming load P2, slide rear side if it was raised by the amount b by the corresponding slide adjustment mechanism 10 when the compensatory inclination correction of the slide 7 was effected is raised by the amount a or lowered by the amount b, respectively, thereby restoring the slide 7 to its original horizontal position.

It should be noted that if the higher forming load P1, front side of the slide 7 was lowered and the lower forming load P2, rear side of the slide 7 was raised when the compensatory slide inclination correction was effected, they are now raised and lowered, respectively to restore the slide to its original horizontal position.

Thus, even for a forming operation in which in addition to the predicted eccentric load an unexpected eccentric load develops, it becomes possible to perform the forming operation on the basis of the die based slide inclination correcting data prepared for each die set individually, while keeping the slide 7 in-process rectified from possible inclination. This is an enhanced protection for the slide 7 against inclination which makes it possible to achieve precision forming of work pieces without impairing their productivity.

Figure 9:
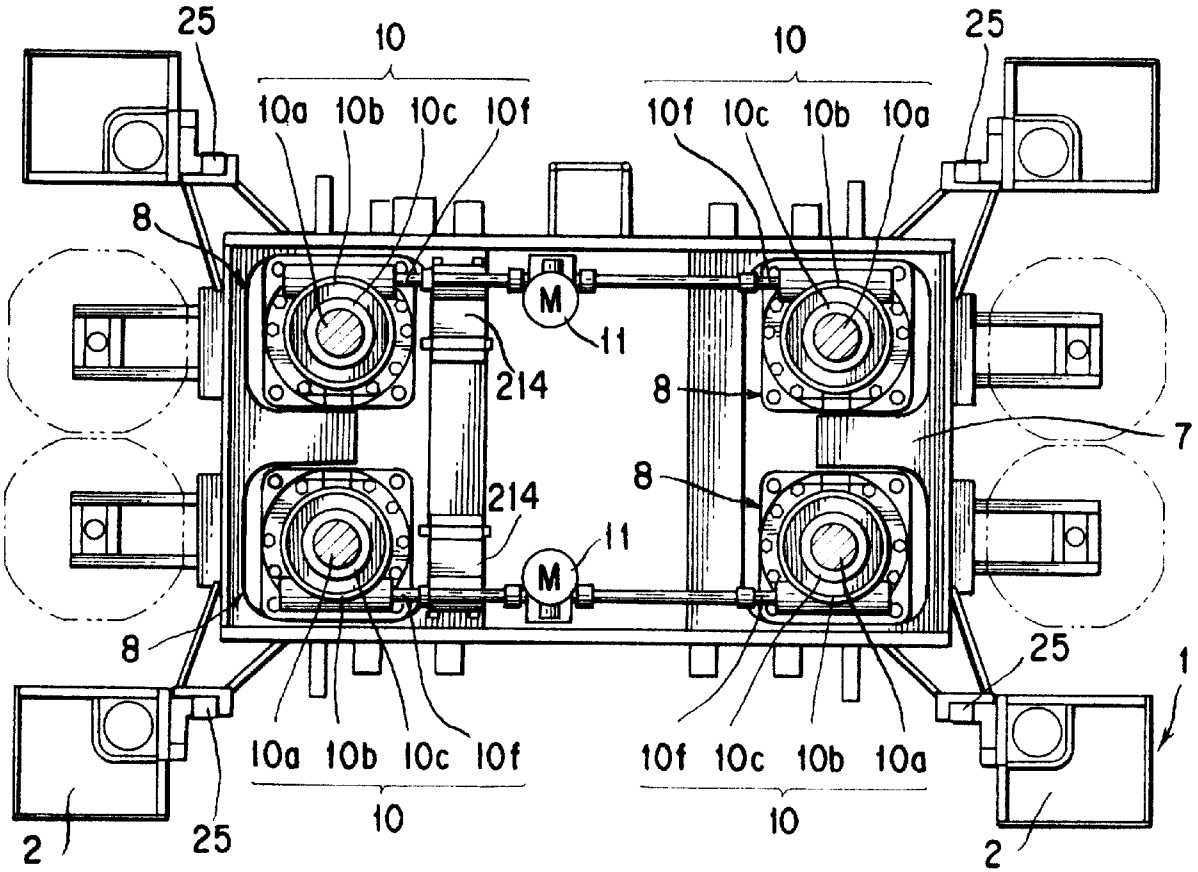
FIG. 9 is a top plan view diagrammatically illustrating a modification of a slide adjustment mechanism for use in the slide inclination correcting apparatus in press machinery according the third form of embodiment of the present invention.

Also, in case an excess load develops during the forming process, the arrangement shown and described allows the slide drive mechanism 4 to be protected against the excess load as heretofore by letting the fluid in the fluid chamber 12*a* escape into the overload protector valve While in the third form of embodiment, a slide adjustment mechanism 10 is provided for each of the points 8 with one adjustment motor 11 for each slide adjustment mechanism, it should be noted that it is possible as in a modification shown in FIG. 9 to provide two sets of slide adjustment mechanisms 10 transversely of the slide 7 with each set comprising slide adjustment mechanisms 10 arranged longitudinally of the slide 7 and to provide one adjustment motor 11 for each set so as to drive the slide adjustment mechanisms in the set simultaneously.

This modification provides an identical amount of adjustment longitudinally of the slide 7 but with the ability to impart to the slide 7 an inclination transversely thereof is particularly effective to a press forming process in which an eccentric load develops especially in a transverse direction.

Figure 10:
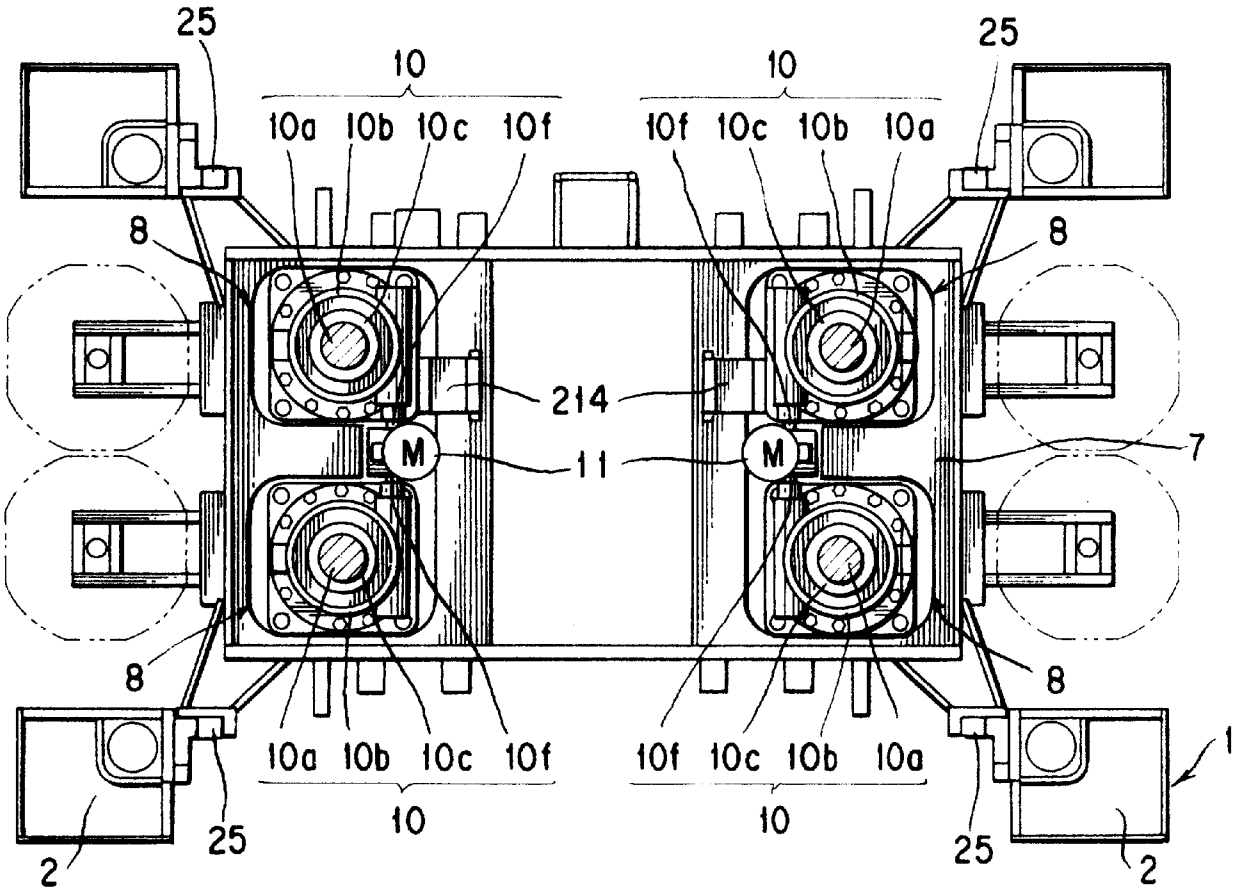
FIG. 10 is a top plan view diagrammatically illustrating another modification of a slide adjustment mechanism for use in the slide inclination correcting apparatus in press machinery according the third form of embodiment of the present invention.

An alternative modification shown in FIG. 10 provides two sets of slide adjustment mechanisms 10 longitudinally of the slide 7 with each set having slide adjustment mechanisms 10 arranged transversely of the slide 7 and one adjustment motor 11 for each set so as to drive the slide adjustment mechanisms in the set simultaneously.

This modification provides an identical amount of adjustment transversely of the slide 7 but having the ability to impart to the slide 7 an inclination longitudinally thereof is particularly effective to a press forming process in which an eccentric load develops especially in a longitudinal direction.

In detecting an inclination of the slide 7, it should be noted that a variety of alternatives are possible in the third form of embodiment as well. For example, slide inclination detecting means 30 and 30 may be provided, as shown in FIG. 4A, at upper ends of posts 32 and 32 mounted to stand from the bolster 31. Slide inclination detecting means 30 and 30 may also be provided, as shown in FIG. 4B, in walls of uprights 2 and 2. The slide inclination detecting means 30 and 30 are suitably made each of a gap sensor.

It should further be noted that adopting a slide inclination detecting means in accordance with the present invention allows the degrees of freedom of flow of work pieces and die design to be improved to a large extent.

See, for example, FIGS. 5A to 5D which show a tandem press line as in the first form of embodiment in which a pair of press machines are installed. In addition to a typical forming process as shown in FIG. 5A in which work pieces are conveyed from the press machine $I_1$ upstream to the press machine $I_2$ downstream to progressively form the work pieces, it becomes possible to mount a plurality of dies or die sets 33 onto each of the press machines $I_1$ and $I_2$ while permitting the work pieces to be conveyed in directions as shown by the arrows in FIGS. 5B to 5D to form the work pieces so in succession. Thus, the ability to admit different forming loads in different process steps ensues which improves the degrees of freedom of the directions in which work pieces are to flow and die design to a large extent.

While the present invention has hereinbefore been set forth with respect to certain illustrative forms of embodiments thereof, it will readily be appreciated to be obvious to a person skilled in the art that many alternations thereof, omissions therefrom and additions thereto can be made without departing from the essences of scope of the present invention. Accordingly, it should be understood that the invention is not intended to be limited to the specific forms of embodiment thereof set forth below, but to include all possible forms of embodiment thereof that can be made within the scope with respect to the features specifically set forth in the appended claims and encompasses all the equivalents thereof.

What is claimed is:

1. A slide inclination correcting apparatus in press machinery having a slide drive mechanism disposed in a top area of a press body for driving a slide via a plurality of points to vertically move it up and down, thereby forming a work piece, the apparatus comprising:

a die based slide inclination correcting data acquisition means for acquiring a die based slide inclination correcting data by finding by measurement or computation for each of dies or die sets an eccentric load that is to develop in the slide in the process of forming a work piece;

a slide adjustment mechanism provided for each of said points; and a slide inclination correction means for pre-imparting to the slide a compensatory amount of inclination corresponding to a predicted amount of inclination caused by the slide due to the eccentric load, by driving said each slide adjustment mechanism on the basis of the die based slide inclination correcting data acquired by said die based slide inclination correcting data acquisition means.

2. A slide inclination correcting apparatus in press machinery as set forth in claim 1, wherein an adjustment motor is provided for said slide adjustment mechanism provided for each of said points.

3. A slide inclination correcting apparatus in press machinery as set forth in claim 1, comprising sets of said slide adjustment mechanisms with each set comprising a single or a plurality of slide adjustment mechanisms provided, respectively, with an adjustment motor.

4. A slide inclination correcting apparatus in press machinery as set forth in any one of claims 1 to 3, the apparatus further comprising a means for bringing the press machine when running to a halt if a relative difference between compensatory amounts of inclination of different slide adjustment mechanisms exceeds a pre-established value.

5. A slide inclination correcting apparatus in press machinery as set forth in any one of claims 1 to 3, the apparatus further including:

a slide inclination detecting means for detecting an actual amount of inclination of the slide; and a means for applying to the slide adjustment mechanism a feed back control on the basis of the actual amount of inclination detected, such that a lower surface of the slide and an upper surface of a bed or bolster become parallel to each other.

6. A slide inclination correcting apparatus in press machinery as set forth in any one of claims 1 to 3, the apparatus comprising:

a slide inclination detecting means for detecting an actual amount of inclination of the slide; and a means for feeding to the die based slide inclination correcting data a compensatory amount of inclination derived from the actual amount of inclination detected.

* * * * *